US005332992A

United States Patent [19]

Woods

[11] Patent Number: 5,332,992

[45] Date of Patent: Jul. 26, 1994

[54] SECURITY ALARM SWITCH

[76] Inventor: Randall Woods, 1569 Eagle Rd., Prescott, Ariz. 86301

[21] Appl. No.: 43,216

[22] Filed: Apr. 6, 1993

[51] Int. Cl.[5] ..... G08B 13/08; H01H 9/00; H01H 3/16

[52] U.S. Cl. ..... 340/547; 340/545; 335/205; 200/61.7

[58] Field of Search ..... 340/545, 547, 571; 335/205, 207; 200/61.7, 61.71, 61.72, 61.73, 61.45 R, 61.62, 61.93; 341/32

[56] References Cited

U.S. PATENT DOCUMENTS

| | | | |
|---|---|---|---|
| 3,535,664 | 10/1970 | Staar | 335/207 |
| 3,630,168 | 12/1971 | Fladlay | 200/61.45 R |
| 3,650,347 | 3/1972 | Campos | 200/61.45 R |
| 3,842,377 | 10/1974 | Barndt | 335/207 |
| 4,042,796 | 8/1977 | Zink | 200/61.45 R |
| 4,168,410 | 9/1979 | Norris | 200/61.45 R |
| 4,275,391 | 6/1981 | Okamura | 340/571 |
| 4,326,196 | 4/1982 | Plevy | 340/545 |
| 4,450,326 | 5/1984 | Ledger | 200/61.45 M |

*Primary Examiner*—James J. Groody

*Assistant Examiner*—John W. Miller

*Attorney, Agent, or Firm*—Hovey, Williams, Timmons & Collins

[57] ABSTRACT

A magnetic switch assembly (10) is provided for detecting relative movement between first and second adjacent members (14, 18), and to defeat attempted magnetic manipulation of the assembly (10). The assembly (10) includes a pair of adjacent, superposed, upper and lower switch elements (22, 24) adapted for mounting on the first member (14), with the lower switch element (24) presenting a sloped surface (26). A shiftable, ferromagnetic ball (34) is disposed between the elements (22, 24) and movable along surface (26) between spaced upper and lower switch operating positions. A magnet (36) adapted for mounting on the second member (18) is also provided, and is oriented for normally retaining the ball (34) in the upper position thereof; however, upon movement of the member (18), the ball (34) is permitted to shift downwardly along the sloped surface (26) to the lower switch operating position thereof. Attempted magnetic manipulation via external magnet (48) also causes the ball (34) to shift from the upper to the lower position thereof.

11 Claims, 1 Drawing Sheet

Fig. 1.
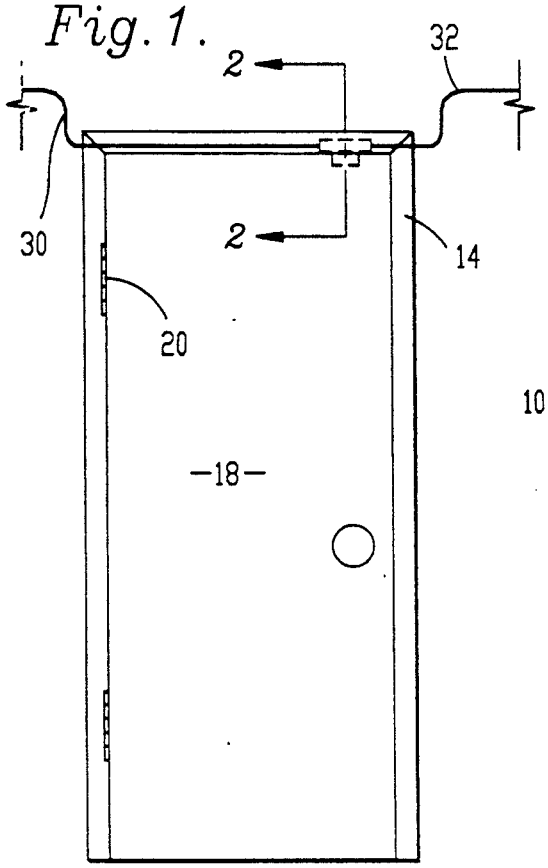
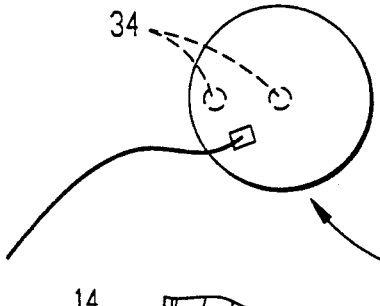
Fig. 5.
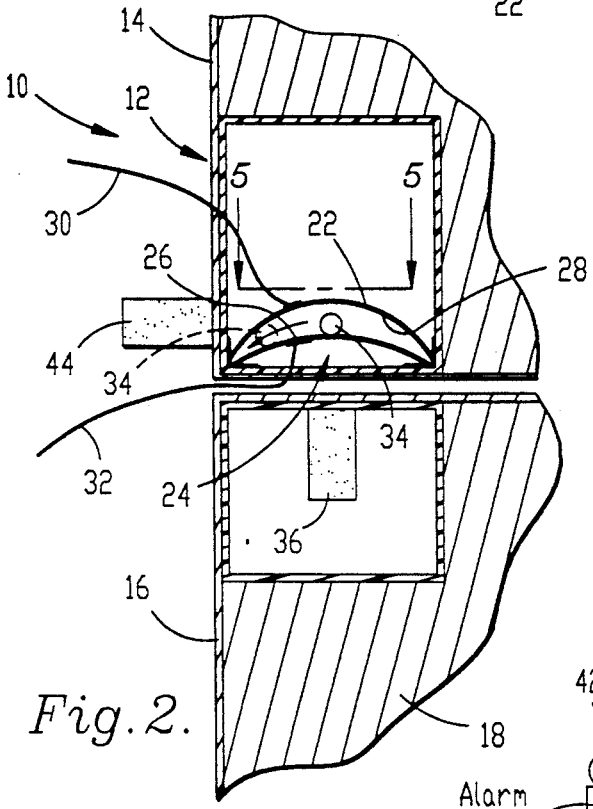
Fig. 2.
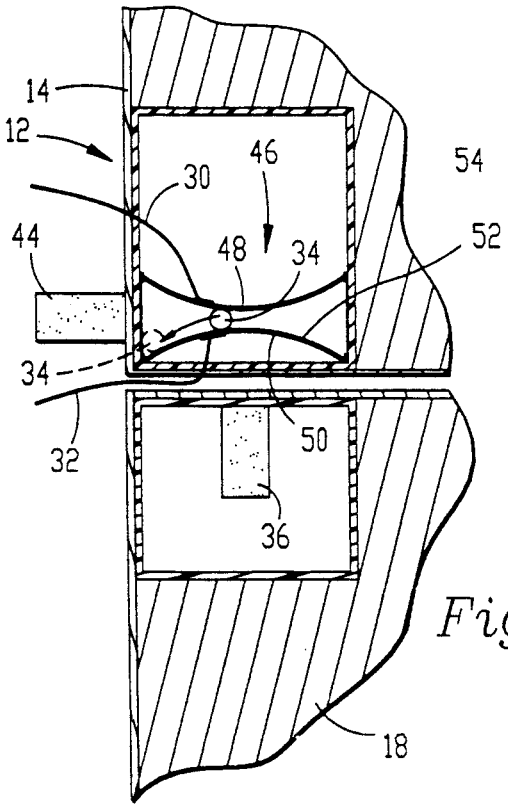
Fig. 3.
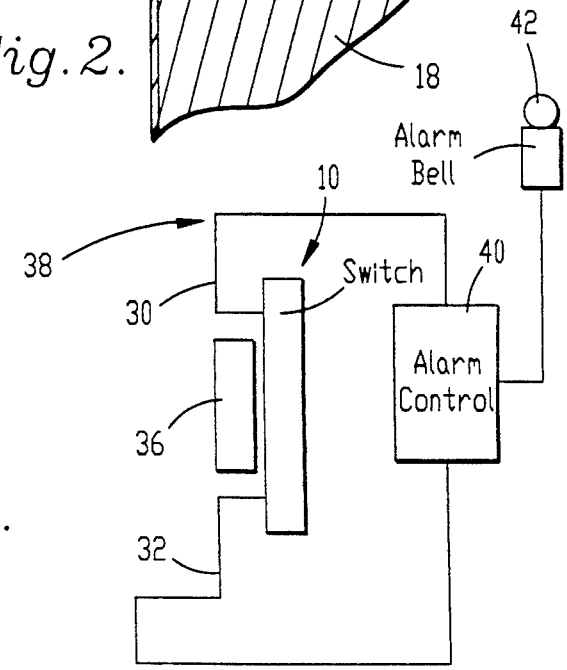
Fig. 4.

SECURITY ALARM SWITCH

BACKGROUND OF THE INVENTION

1. Field of the Invention

The present invention is broadly concerned with an improved magnetic switch assembly of the type used in conjunction with a security system to detect unauthorized entry through doors or windows. More particularly, it is concerned with such a switch assembly which is especially configured to defeat attempted magnetic manipulation of the switch assembly so as to permit opening of the door or window without detection thereof. To this end, the switch assembly includes a pair of adjacent, upper and lower switch elements mountable within a stationary frame, with a shiftable ferromagnetic body disposed between the elements and movable between spaced upper and lower switch operating positions; a magnet is mounted in the movable door or window and is oriented for effecting movement of the body upon opening of the door or window between switch operating positions. In the event that an external magnet is placed adjacent the switch elements during an attempted unauthorized entry, the ferromagnetic body is moved to the lower switch position, thereby detecting such attempted manipulation.

2. Description of the Prior Art

Modern-day building security alarm systems make use of door and window switch assemblies which are designed to detect unauthorized opening thereof. For example, one common switch assembly for this purpose includes a pair of magnetic reed switch elements mounted in a door or window frame, with a magnet carried by the adjacent openable door or window. The magnet carried by the door or window hold the reed elements opened or closed (depending on whether the switch is of the normally opened or normally closed variety) when the door or window is closed; when the latter is opened, the reed switch elements change position. These reed switches are conventionally interposed in the overall alarm circuit, so that upon unauthorized opening of the door or window, the switch operation generates an alarm signal.

One problem with conventional reed switch assemblies of the type described is that they can be readily defeated by simply placing an external magnet adjacent the door or window frame in proximity to the reed switch elements. This allows the door or window to be opened, but the reed switches do not change their positions, owing to the presence of the magnetic field attendant to the external magnet. As a consequence, an intruder may with impunity open the door or window and gain unauthorized access to the seemingly protected building.

There is accordingly a real and unsatisfied need in the art for an improved switch assembly which is designed to defeat attempted magnetic manipulation thereof, and to initiate alarm operation even when an external magnet is employed.

SUMMARY OF THE INVENTION

The present invention overcomes the problems outlined above, and provides a magnetic switch assembly for detecting relative movement between first and second adjacent members such as a door or window relative to its circumscribing frame. At the same time, the switch assembly defeats attempted magnetic manipulation thereof.

Broadly speaking, the switch assembly of the invention includes a pair of adjacent, superposed, upper and lower switch elements for mounting on the first member (e.g., the stationary frame), with the lower switch element presenting a sloped surface. The assembly further includes a shiftable, ferromagnetic body such as a ball which is disposed between the switch elements and movable along the sloped surface between spaced upper and lower switch operating positions. A magnet is also provided for mounting on the second member (e.g., the movable door or window) and is oriented for retaining the ferromagnetic body in its upper switch operating position when the first and second members are in one relative position (e.g., the door or window being closed). However, upon movement of the first and second members to a different position (e.g., the door or window being opened), the body is permitted to shift along the sloped surface to the lower switch operating position where it is retained under the influence of gravity.

Very importantly, the switch elements are located within the first member for movement of the ferromagnetic body from the upper to the lower switch operating positions, when the members are in the first relative position and an external magnet is applied to the second member in an attempt to magnetically manipulate and defeat the switch assembly.

In preferred forms, the switch elements are each of concavo-convex configuration, and are generally circular in plan. These switch elements are adapted for respective electrical coupling via wire leads into an overall alarm system.

The switch assembly of the invention may be configured as normally opened or normally closed. In the first instance, a normally open switch assembly may included a lower switch element presenting an uppermost convex surface, while the adjacent surface of the upper element is concave; the ferromagnetic ball is adapted in the upper position thereof to rest upon the apex of the lower convex surface, in spaced relationship to the adjacent concavo-convex switch element. Where a normally closed switch assembly is desired, the upper surface of the lower element is again convex, and the adjacent lower surface of the upper element is also convex, but oppositely diverging. In this instance, the ferromagnetic ball in the upper position thereof contacts both of the switch elements, thus closing the switch.

As those skilled in the art will appreciate, the switch assembly of the invention may be readily interposed within an overall intruder alarm system, the latter including an alarm circuit for detecting the opening of a door or window. In such a case, the described electrical leads are connected within the system, so that upon attempted forced opening of the door or window, with or without use of an external magnet, the alarm will activate.

BRIEF DESCRIPTION OF THE DRAWINGS

FIG. 1 is an elevational view of a hingedly mounted door protected by a switch assembly in accordance with the invention, the latter being illustrated partially in phantom and shown interposed within an intruder alarm system;

FIG. 2 is an enlarged, fragmentary vertical sectional view of a door-mounted, normally opened switch assembly in accordance with the invention, and also illustrating attempted magnetic manipulation of the switch assembly via an external magnet;

FIG. 3 is a view similar to that of FIG. 2, but illustrating a normally closed switch assembly in accordance with the invention;

FIG. 4 is a schematic representation of an alarm system, with the switch assembly of the invention interposed therein; and FIG. 5 is a view taken along line 5—5 of FIG. 2 and illustrating the upper switch element, and with two positions of the internal switch ball depicted in phantom.

DETAILED DESCRIPTION OF THE PREFERRED EMBODIMENTS

Turning now to the drawings, and particularly FIGS. 1–2, a switch assembly 10 is illustrated. The assembly 10 includes an uppermost synthetic resin housing 12 adapted for mounting within a stationary door or window frame 14, as well as a mating synthetic housing 16 which is positioned within the movable door 18. As shown in FIG. 1, the door 18 is of the conventional type, and is mounted on hinges 20 for movement between a closed position and a door opened position.

Referring specifically to FIG. 2, it will be observed that the upper housing 12 includes a pair of adjacent, superposed, upper and lower switch elements 22, 24, each of generally circular, disc-like, concavo-convex configuration. Specifically, the lower element 24 presents an uppermost convex surface 26, whereas the adjacent element 22 has a concave lower surface 28 in facing relationship to the surface 26. A pair of electrical leads 30, 32 are respectively electrically connected with the upper and lower switch elements 22, 24 as shown.

A ferromagnetic ball 34 is positioned between the switch elements 22, 24 and is movable between an uppermost rest position illustrated in bold lines in FIG. 2, to a lower, switch closing position depicted in phantom. In the latter position, it will be observed that the ball 34 comes into electrical, switch-closing contact with the elements 22, 24 in the lower position thereof.

The lower housing 16 includes a magnet 36 which is strategically oriented so that, when the door 18 is closed as shown in FIG. 2, the magnetic field generated by the magnet 36 causes the ball 34 to be retained in the upper, switch open position thereof.

However, when door 18 is opened, the magnet 36 pulls ball 34 downwardly along the sloped uppermost surface 26 of the lower switch element 24, thereby moving the ball to the lower switch closing position thereof. When the door 18 is fully opened, the ball 34 remains in this lower position under the influence of gravity. Of course, when the door 18 is again closed, the ball 34 is magnetically pulled from its lower position back to the upper, switch open position shown in full lines in FIG. 2, where ball 34 rests at the apex of surface 26.

As shown in FIG. 4, the switch assembly 10 is adapted for mounting within and as a part of an alarm system 38. The latter includes an alarm control assembly 40 as well as an alarm bell 42 or other perceptible alarm device. As shown, the electrical leads 30, 32 are used to interpose the switch assembly 10 within the system 38. Thus, if the alarm system 38 is armed, any attempted opening of door 18 will close switch assembly 10, and alarm signal will be generated to ring bell 42 (or alert a central station, for example). Again referring to FIG. 2, if an intruder attempts to apply an external magnet 44 to frame 14 to defeat switch assembly 10, this has the effect of initiating alarm operation. That is to say, use of the external magnet 44 moves ball 34 down the sloped surface 26 until the ball comes into the lower switch-closing position thereof. At this point, the alarm system 38 is activated, even though the door 18 is not actually opened. Thus, in such situations the present invention provides the earliest possible warning of attempted forced entry.

FIG. 3 illustrates a second embodiment of the invention which includes a normally closed switch assembly 46. Specifically, the upper housing 12 within frame 14 includes adjacent disc-like switch elements 48, 50. The lower switch element 50 presents an uppermost concave surface 52, while the upper element 48 presents a lower concave surface 54; it will be noted that the concave surfaces 52, 54 are relatively divergent, and approach each other at the center of the discs. Magnetic ball 34 positioned between the discs completes the upper portion of the switch assembly. As illustrated, in the upper position of the ball depicted in full lines, the switch is closed. When the door 18 is opened, magnet 36 serves to move the ball 34 downwardly along the sloped surface 52 to the lower switch-open position illustrated in phantom in FIG. 3. Attempted magnetic manipulation of the assembly 46 via external magnet 44 is also defeated in this embodiment. That is, the presence of external magnet 44 simply pulls ball 34 to its lower position, and allows the overall alarm system 38 to appropriately activate and react.

I claim:

1. A magnetic switch assembly for detecting relative movement between first and second adjacent members, and for defeating attempted magnetic manipulation of the switch assembly so as to permit said relative movement without detection thereof, said switch assembly comprising:

a pair of adjacent, superposed, upper and lower switch elements for mounting on said first member, said lower switch element presenting a sloped surface;

a shiftable, ferromagnetic body disposed between said elements and movable along said sloped surface between spaced upper and lower switch operating positions; and a magnet for mounting on said second member and oriented for retaining said body in said upper switch operating position when said members are in one relative position, and, upon movement of the members to a second relative position, for permitting shifting of said body along said sloped surface to said lower switch operating position for retention thereat under the influence of gravity, said switch elements being located for movement of said body from said upper to said lower switch operating position, when said members are in said one relative position and an external magnet is applied to said first member in an attempt to magnetically manipulate the switch assembly.

2. The switch assembly of claim 1, said switch elements each being of concavo-convex configuration, with said lower switch element presenting an uppermost convex surface, and with the adjacent surface of said upper element being concave.

3. The switch assembly of claim 1, said switch elements being of concavo-convex configuration, the upper surface of said lower element being convex, and the adjacent lower surface of the upper element being convex.

4. The switch assembly of claim 1, said switch elements being circular in plan configuration and being formed of electrically conductive material.

5. The switch assembly of claim 1, said ferromagnetic body comprising a ball.

6. The switch assembly of claim 1, said switch assembly being a door switch for a hingedly mounted door having a circumscribing door frame, said switch elements being for mounting within said door frame, and said magnet being for mounting in said door and movable therewith.

7. In an electrical intruder alarm system including an alarm circuit for detecting the opening of a door or window shiftable within a circumscribing frame, an improved magnetic switch assembly interposed within said circuit and comprising:

a pair of adjacent, superposed, upper and lower switch elements mounted in said frame, said lower switch element presenting a sloped surface;

a shiftable, ferromagnetic body disposed between said elements and movable along said sloped surface between spaced upper and lower switch operating positions; and a magnet mounted in said door or window and oriented for retaining said body in said upper switch operating position when said door or window is closed, and, upon opening of the door or window, for permitting shifting of said body along said sloped surface to said lower switch operating position for retention thereat under the influence of gravity, said switch elements being located for movement of said body from said upper to said lower switch operating position, when said door or window is closed and an external magnet is applied to said frame in an attempt to magnetically manipulate the switch assembly.

8. The alarm system of claim 7, said switch elements each being of concavo-convex configuration, with said lower switch element presenting an uppermost convex surface, and with the adjacent surface of said upper element being concave.

9. The alarm system of claim 7, said switch elements being of concavo-convex configuration, the upper surface of said lower element being convex, and the adjacent lower surface of the upper element being convex.

10. The alarm system of claim 7, said switch elements being circular in plan configuration and being formed of electrically conductive material.

11. The alarm system of claim 7, said ferromagnetic body comprising a ball.

* * * * *